US008117862B2

(12) United States Patent
Helt et al.

(10) Patent No.: US 8,117,862 B2
(45) Date of Patent: Feb. 21, 2012

(54) DEVICE AND METHOD FOR RECORDING AIR CONDITIONING SYSTEM INFORMATION

(75) Inventors: Robert W. Helt, Tyler, TX (US); Jie Song, Shanghai (CN); Gordon Jeffrey Hugghins, Jacksonville, TX (US); John Tanner Taylor, Flint, TX (US); W. Randall Erwin, Tyler, TX (US); Stephen Kowalski, Tyler, TX (US); Bruce David Montgomery, Flint, TX (US); Timothy W. Storm, Tyler, TX (US); Alan Dale Marble, Whitehouse, TX (US); James T. Schaefer, Jr., Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 550 days.

(21) Appl. No.: 11/717,466

(22) Filed: Mar. 13, 2007

(65) Prior Publication Data

US 2008/0223944 A1 Sep. 18, 2008

(51) Int. Cl.
*F25D 19/00* (2006.01)

(52) U.S. Cl. ..... 62/298; 236/1 C; 236/51; 236/92 R

(58) Field of Classification Search ..... 62/127, 62/298; 236/1 C, 51, 92 R; 700/276, 300; 702/182, 188

See application file for complete search history.

(56) References Cited

U.S. PATENT DOCUMENTS

| | | | | |
|---|---|---|---|---|
| 4,516,929 | A * | 5/1985 | Hiroi et al. | 431/12 |
| 5,831,852 | A | 11/1998 | Cahill-O'Brien et al. | |
| 6,330,806 | B1 | 12/2001 | Beaverson et al. | |
| 6,615,123 | B2 | 9/2003 | Morehouse | |
| 6,708,505 | B2 | 3/2004 | Nakamura et al. | |
| 6,711,474 | B1 | 3/2004 | Treyz et al. | |
| 6,718,781 | B2 * | 4/2004 | Freund et al. | 62/199 |
| 7,044,397 | B2 | 5/2006 | Bartlett et al. | |
| 2005/0040250 | A1 * | 2/2005 | Wruck | 236/51 |
| 2005/0172075 | A1 * | 8/2005 | Marcus | 711/115 |
| 2005/0275525 | A1 * | 12/2005 | Ahmed | 340/524 |
| 2006/0249589 | A1 * | 11/2006 | Karamanos | 236/49.3 |

* cited by examiner

*Primary Examiner* — Frantz Jules
*Assistant Examiner* — Daniel C Comings
(74) *Attorney, Agent, or Firm* — Conley Rose, P.C.; J. Robert Brown, Jr.

(57) ABSTRACT

HVAC apparatus is configured to include a control system with a controller which may be connected directly to a personality module for transferring information stored in the controller related to historic operating conditions of the apparatus to the module, or information may be transferred to the controller from the module to configure the controller for operation of the apparatus at selected operating conditions of temperature, pressure and blower motor speed, for example. The personality module includes a memory circuit and a connector for releasably connecting the module to the control system of the apparatus for transferring information between the module and the controller.

15 Claims, 3 Drawing Sheets

| Data Type | Blower Application |
|---|---|
| Personality Module Serial Number | PSC, CTM, VS |
| Model Number | PSC, CTM, VS |
| Serial Number | PSC, CTM, VS |
| Model ID | PSC, CTM, VS |
| Capacity, per ComfortLink™II | PSC, CTM, VS |
| # Available Motor Speed Taps | PSC, CTM |
| Default Fan Speed Tap | PSC, CTM |
| Default Cool Speed Tap | PSC, CTM |
| Default Heat Speed Tap, High | PSC, CTM |
| Default Heat Speed Tap, Low | PSC, CTM |
| Allowed Tonnage Combinations | VS |
| Airflow,CFM/Ton, Nominal, Adjust + and Adjust -,divided by 10 | VS |
| Continuous Fan Multipliers, 0 to 200 = 0 – 100% | VS |
| Heating Airflow, Actual value divided by 10 | VS |
| Compressor Stage Multipliers, 0 to 200 = 0 – 100% | VS |
| Dehumidification Multiplier, 0 to 200 = 0 – 100% | VS |
| Heating Stage Multipliers, 0 to 200 = 0 – 100% | VS |
| Inducer Default Speeds, RPM, divide by 100 | Not Used by AH |
| Maximum Airflow, CFM, Actual value divided by 10 | VS |
| Motor Horsepower, NIBBLE | VS |
| Maximum Speed, RPM | VS |
| Cut Torque Rate, oz-ft/RPM | VS |
| Rotation Direction | VS |
| Slew Rate, Cooling | VS |
| Slew Rate, Heating | VS |
| Slew Rate, Emergency | VS |
| OEM Code Nibble and Motor Constants, A1 through A4 | VS |
| Mnemonic Part Number | PSC, CTM, VS |
| CRC | PSC, CTM, VS |

FIG. 3

DEVICE AND METHOD FOR RECORDING AIR CONDITIONING SYSTEM INFORMATION

BACKGROUND OF THE INVENTION

In the art of heating, ventilating and air conditioning (HVAC) equipment, there is an ever increasing utilization of electronic based or configured controls. The use of microprocessors for monitoring the status of an HVAC system and certain operating conditions, effecting control over operation of the HVAC system and for the storage of suitable system identification information has become increasingly common. However, one problem associated with the use of microprocessor based air conditioning system controls is the difficulty in obtaining accurate information concerning the operation and performance of the air conditioning equipment. Still further, control systems have been developed which have the capability to transmit information to remote locations via various types of data transmission equipment. However, human observation of operation of air conditioning equipment is, typically, a major source of information and known types of controls typically require external devices which must be connected to a microprocessor control board, for example, and require an interface and a computer to retrieve desired information. Such methods are cumbersome, expensive and difficult to implement.

Accordingly, with the increasing sophistication of air conditioning systems equipped with electronic controls, there has been a need to develop an information storage device which is removable from the control system processor so that information regarding, for example, the operation of air conditioning equipment may be analyzed and so that suitable control functions may be modified, as needed, by personnel servicing the air conditioning equipment. Moreover, there has also been a need to provide so-called generic controllers or control systems for air conditioning equipment which may be programmed or provided with operating parameters after completion of manufacture and even after installation of such equipment. It is to these ends that the present invention has been developed.

SUMMARY OF THE INVENTION

The present invention provides an information storage device or module for use in conjunction with HVAC equipment and a method of storing and retrieving information using or implementing such a device.

In accordance with one aspect of the present invention an information storage and retrieval device or module is provided which is operable to store a relatively large amount of information in a unit of compact physical size and which may be connected to a control system for a unit of HVAC equipment, hereinafter referred to as air conditioning equipment. By provision of a suitable port on the control system, such as on a circuit board of the control unit microprocessor, information may be automatically transferred to the device or transferred from the device or module. Accordingly, the device can be retrieved at a selected time and the information may be used, as needed, by servicing personnel.

Another aspect of the invention includes the provision of a device or module which may be releasably and operably connected to a control system for an air conditioning unit for retrieving information concerning the operating status and operating parameters of the unit and also for use in performing upgrades or modifications to the operating parameters of the control system.

Still further, the invention provides an information storage and retrieval device which may be utilized with air conditioning equipment wherein the control system for the air conditioning equipment, with respect to each particular unit or equipment, may be produced as a generic system and then "personalized" by using the device to input to the system controller such information as system model number, serial number, and specific data which can be utilized in operating the system.

The information storage device may be utilized to update existing so-called generic control systems from time to time in the field so that existing equipment has access to the latest processes and control features. The device or module may incorporate an EEPROM memory unit on a circuit board with a connector so that it can exchange data with a control board or microprocessor forming part of a control system for a particular unit of air conditioning equipment. Model specific data may be transferred to the control system and program files or upgrades to a basic program residing on the control system can be provided utilizing the so-called "personality module" or device of the present invention. Of course, control of information such as historical data including, for example, the number of operating cycles of the air conditioning equipment can be stored on the so-called personality module for future use and diagnostic work.

Still further, the device of the present invention can be utilized with respect to calibration data for parameters such as operating pressures and temperatures required for efficient, continuous and reduced hazard system operation. Such an arrangement allows the use of control system elements, such a thermistors or pressure transducers, in conjunction with air conditioning equipment instead of specialized switches having unique calibrations of temperature or pressure. Such an improvement simplifies the manufacturing process for air conditioning equipment and reduces the amount of information gathering, such as bar code scanning, of each of the components of the equipment at the point of manufacture.

In accordance with yet another aspect of the present invention, the aforementioned information storage personality module or device may contain information concerning the air flow characteristics for or calibration information of a particular type of air conditioning equipment on which it is installed and which may be specially programmed for laboratory use. Such devices may contain override data or instructional programming for nonstandard operating conditions, for example. Moreover, a so-called functional parts list may be carried on the information storage module or device as part of the information stored therein which would reduce the amount of documentation used in manufacturing, shipping and servicing a unit of air conditioning equipment, for example.

The aforementioned personality module or device may be of a particular shape which is easily recognizable and allows it to be inserted correctly in a matching connector part for connecting the device to the control system or control board of the equipment with which the device is to be used. The shape of the personality module or device is also such that the correct side to be connected to the control system can be detected by personnel manipulating and being able to feel the configuration of the device. The device may have features including a tether for maintaining it attached to the air conditioning equipment in which it is installed and matched, for example.

Those skilled in the art will further appreciate the advantages and superior features of the invention upon reading the detailed description which follows in conjunction with the drawings.

BRIEF DESCRIPTION OF THE DRAWINGS

FIG. 3 is a table of typical items of information storable in the device of the invention;

DETAILED DESCRIPTION OF PREFERRED EMBODIMENTS

Figures 1, 2:
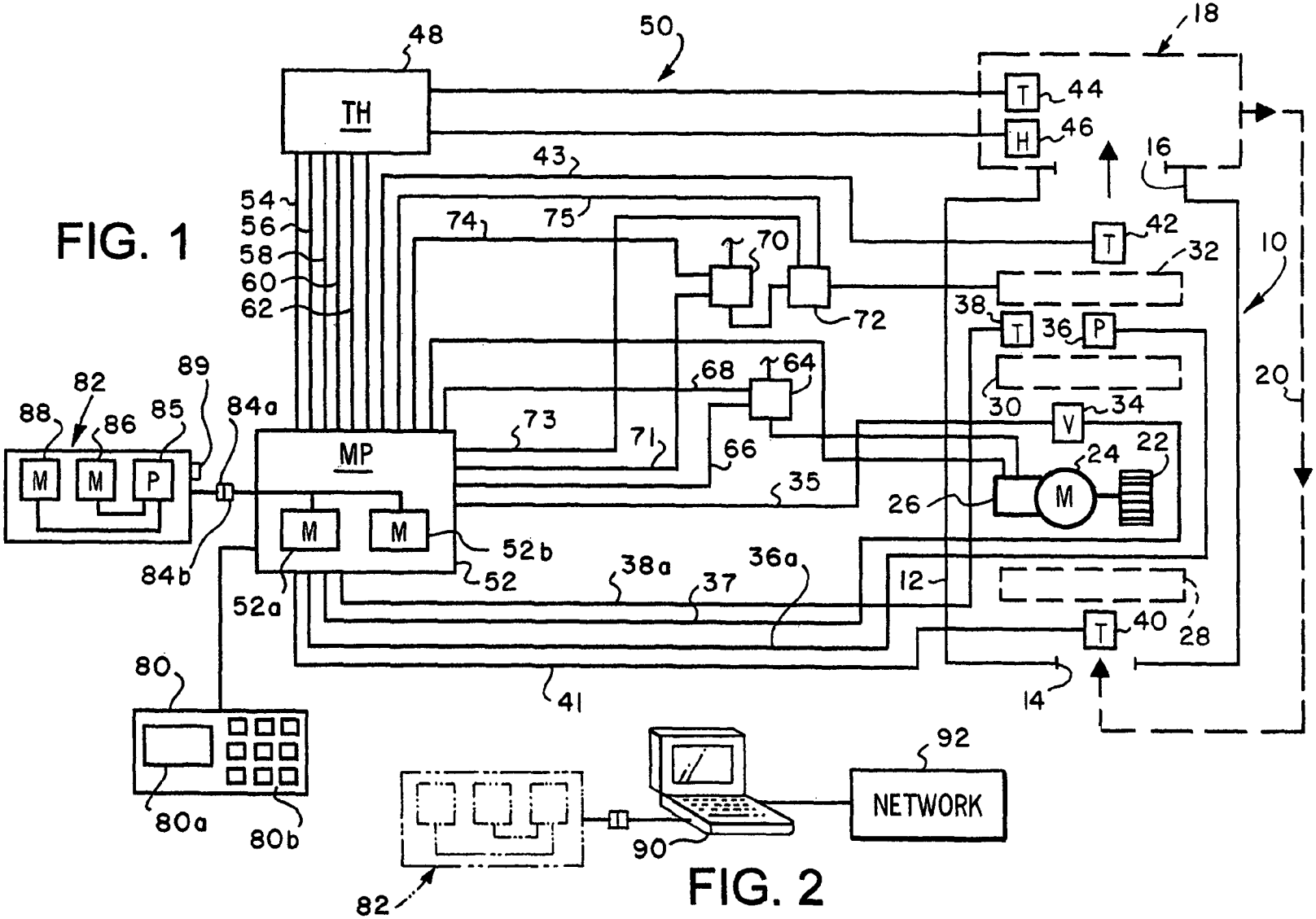
FIG. 1 is a schematic diagram of a typical control system for a unit of air conditioning equipment and illustrating the information storage and transfer module or device of the invention.
FIG. 2 is a detail view showing the device of the invention connected to a processor for transferring information therebetween.

In the description which follows like elements are marked throughout the specification and drawing with the same reference numerals, respectively. Certain elements and/or features may be shown in schematic form in the interest of clarity and conciseness.

Referring to FIG. 1, there is illustrated an air conditioning apparatus, generally designated by the numeral 10, shown in schematic form. Apparatus 10 may take various forms but, in the embodiment illustrated, is shown to include a cabinet 12 having an air inlet or return air opening 14 and an air discharge opening 16 connected by suitable ducting to a suitable enclosed space 18. Air returns from space 18 to the cabinet 12 via a path 20. Air conditioning apparatus 10 includes a motor driven blower or fan 22 connected to an electric drive motor 24 which may include its own control unit 26, as illustrated. Motor driven blower 22 is disposed within cabinet 12, typically in a flow path wherein air entering the cabinet may flow over a cooling coil type heat exchanger 28, then through blower 22 to a heat exchanger 30 which may comprise a combustion furnace, for example. Yet another type of air heating means may be disposed in cabinet 12 including an electric resistance grid type heater 32, as indicated in FIG. 1. In applications of air conditioning apparatus 10 which includes a combustion furnace, there is typically an electrically operated gas flow control valve 34 and pressure and temperature sensors 36 and 38 associated with furnace 30 for monitoring the combustion process and operating parameters of the combustion furnace. Additional temperature sensors associated with the apparatus 10 may include a return air temperature sensor 40, an apparatus discharge temperature sensor 42, a temperature sensor 44 within the space 18 and, possibly, a humidity sensor 46 for sensing the humidity within the space 18. Sensors 44 and 46 are connected to a thermostat 48, as indicated.

A preferred control system for the apparatus 10, indicated generally by numeral 50, includes a microprocessor 52 and additional control elements to be described. Microprocessor 52 is operably connected to the thermostat 48 via signal conductors, including conductors 54, 56, 58, 60 and 62 which, respectively, may provide signals to the microprocessor including a first stage call for heat, a second stage call for heat, a first cooling stage call, a continuous fan operating mode signal, and possibly, a heat pump operating signal. The apparatus 10 illustrated, typically includes a vapor compression compressor and condenser unit, not shown, operably connected to the evaporator or cooling coil 28 and possibly configured for either air cooling operation only or heat pump operation. Those skilled in the art will recognize that, in a typical air conditioning apparatus, multiple sources of heat may or may not be available. However, for convenience in describing the invention in this application the apparatus 10 has been shown to include at least one source of cooling effect, namely, the heat exchanger 28, and single or multiple sources of heating which could include the heat exchanger 28, includes the combustion furnace 30 and could include the electric heater 32. Alternatively, multiple stages of electric heating could be incorporated in the apparatus 10 in place of the combustion furnace 30.

Accordingly, for the particular configuration of the apparatus 10, as illustrated, the control system 50 typically includes a motor control relay 64, FIG. 1, operable to receive a signal from the microprocessor 52 by way of a conductor 66 and wherein a feedback signal from the relay 64 may be input to the microprocessor via a conductor 68. Still further, the electric heating element 32 may include a control relay 70 and an interlock relay 72 operable to receive signals from the microprocessor 52 by way of conductor means 71 and 73, respectively, with relay status feedback signals input to the microprocessor via conductors 74 and 75, respectively. Temperature sensors 40 and 42 provide input signals to the microprocessor 52 by way of conductor means 41 and 43, respectively. Combustion furnace control valve 34 receives a control signal via conductor means 35 output by controller or microprocessor 52 and provides a status feedback signal via conductor means 37. Sensors 36 and 38 provide signals to the controller 52 via conductor means **36*a* and 38*a***, respectively.

As further shown in FIG. 1, controller or microprocessor 52 may include an interface 80 having a visual display **80*a* and human operable input means including a keypad or touch screen 80*b* for altering the operating characteristics of the controller 52 or for reading information therefrom. However, an advantage of the apparatus 10, including its control system 50, is the provision of an information storage and retrieval device in accordance with the invention, generally designated by the numeral 82. Device 82 may be characterized as a so-called personality module and may be operably connected to the controller 52 through suitable connector means 84*a*, 84*b* to transfer information between the controller 52 and the device 82. In this regard the device 82 may include its own processor 85 and one or more memory units 86 and 88, for example. Processor 85 may also be operable to communicate information to and from memory means 86, 88 through an optical communications link 89, for example. Accordingly, the device or module 82 may be releasably connected to the controller 52 to alter certain operating parameters of the controller, record information as to the current operating status of the apparatus 10 and its control system 50, record historic operating data, and provide a technician with a list of the manufacturer's part numbers for components of the apparatus 10 and its control system 50**, for example.

Device 82 may be disconnected from controller 52 and connected to a processor 90, FIG. 2, which may or may not be connected to a communications network 92 for communicating information to and from the device or module 82, as needed. The memory requirements of device 82 may be satisfied by a non volatile memory, such as a 16K bit EEPROM, which may be a type M24C16 available from ST Microelectronics, or a Microchip Technologies type 24LC16B, for example. The connector 84 may be a type available from JST as their part no. S4B-JL-F-E, or equivalent.

As mentioned previously, the module or device 82 may be programmed at the manufacturing location of the apparatus 10 to store information concerning the specific model of the apparatus. Examples of data stored in the memories 86, 88 are the apparatus model and serial number, air flow data, and a list of specific part numbers for replaceable parts that are specific to the particular apparatus with which the module 82 is associated. The information stored in the module or device 82 that is necessary for operation of the apparatus 10 is transferred into one or more memories 52*a* and/or 52*b*, FIG. 1, of the controller or processor 52.

Accordingly, data necessary for operation of the apparatus 10 and its control system 50, when transferred into the memories 52*a* and/or 52*b*, allows normal operation of the apparatus in the event the module 82 is removed or becomes unreadable. Normally, at power-up of the control system 50, the controller or processor 52 compares locally stored memory data in the memory 52*a* and/or 52*b* with the data stored in the memory 86 and/or 88. The system 50 may be programmed to accept valid data from device 82 which would supersede any locally stored data in the controller 52. FIG. 3 illustrates, for example, a table of typical types of data stored in the module or device 82 for a particular type of motor 24 used in the apparatus 10, such a motor including, for example, one of a PSC motor (permanent split capacitor), a CTM motor (constant torque motor), and a serial communicating variable speed motor (VS).

Figure 4:
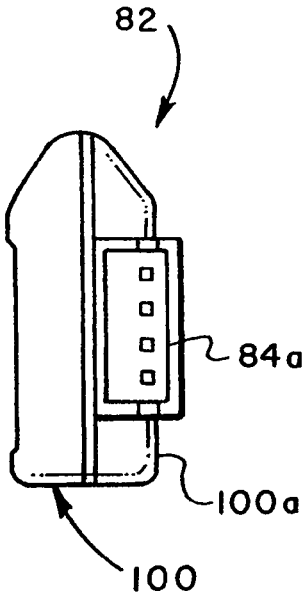
FIG. 4 is an end view of a preferred embodiment of the device of the invention.
Figure 5:
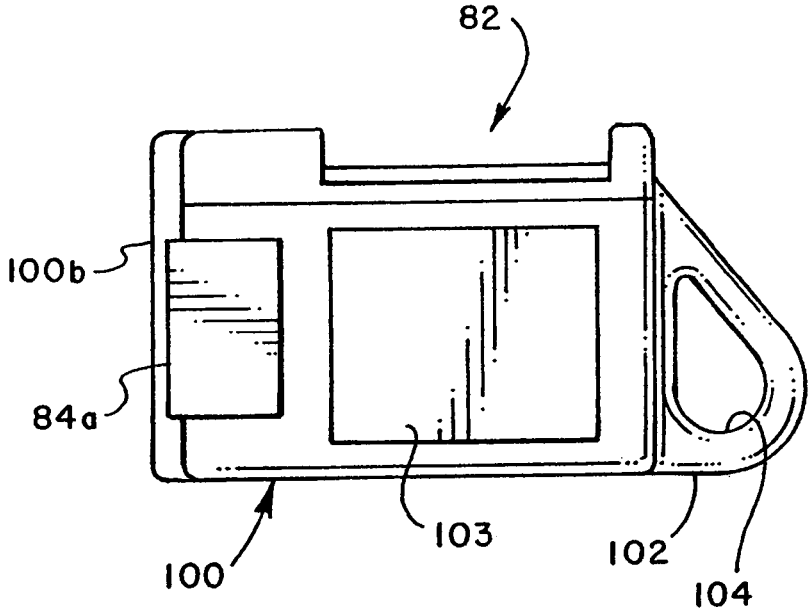
FIG. 5 is a side elevation of the device.

Referring now to FIGS. 4 and 5, there is illustrated a preferred physical embodiment of the device or module 82 which includes a generally rectangular box-like housing 100 having a boss 102 at one end, FIG. 5, with an opening 104 formed therein for attaching a tether or the like, not shown, to the module. Connector 84*a* projects in a longitudinal direction from one side 100*a* of housing 100 and is aligned generally with one end 100*b* of housing 100 to facilitate connecting the module or device 82 to the connector part 84*b* of controller 52 or to a corresponding connector part associated with the processor 90, FIGS. 1 and 2. Suitable indicia may be applied to the housing 100 via a label 103, as indicated in FIG. 5. The physical dimensions of the module 82 are not remarkable and the module or device 82 may be easily handheld and transported. For example, the overall length of the housing 100 may be on the order of about 1.8 inches, including the boss 104, the overall height may be on the order of 1.0 inch, and the thickness of the housing may be less than 0.50 inches.

Accordingly, the module or device 82 enables the obtaining of accurate information about the operation and performance of HVAC equipment, such as the apparatus 10 and the module may be easily connected to and disconnected from the control system 50 via the connector 84*a*, 84*b*. Moreover, data or information may also be transferred via a LITE PORT connector, such as connector 89, FIG. 1, if desired. Once the module or device 82 is connected to the controller 52, for example, information in the controller memories 52*a* and/or 52*b* may be automatically stored in the module and information in the module may be transferred to the controller 52, such information being of the types described hereinbefore. Still further, the control system 50 may be upgraded as to its performance parameters by putting such information in the module 82 via a processor, such as the processor 90 and once the controller 52 detected a connection to the module 82 the upgrade information would be transferred to the control system 50.

Moreover, as mentioned previously, equipment or apparatus model specific data may be transferred to the controller 52, upon energization of the controller 52 and upon energization of the apparatus 10 and its control system 50. Accordingly, generic control components, such as the controller 52, may be provided when the equipment or apparatus 10 is manufactured and prepared for placement in service.

Still further, the apparatus 10 may be provided with sensors, such as the sensors 36 and 38, rather than pressure responsive or temperature responsive switches, and operating parameters for a particular apparatus 10 may be placed in the memory of module 82 and then transferred to the controller 52 for a particular model of apparatus 10 whereby the calibration of pressure and temperature conditions required for continuous operation can be stored on the module and transferred to the controller on a model by model basis. In this way also, the module 82 may be programmed for laboratory usage in selecting nonstandard airflow parameters and control override capabilities. As mentioned previously, a parts list for each apparatus 10, including descriptions for various replacement parts, may be programmed into the module 82 to reduce the amount of paper documents used in shipping documentation or literature associated with each apparatus.

Those skilled in the art will recognize that the fabrication and operation of the apparatus 10, its control system 50 and the module or device 82 may be carried out based on the description herein and information available to and known to those skilled in the art. Although a preferred embodiment of the invention has been described in detail those skilled in the art will also recognize that various substitutions and modifications may be made to the specific embodiment described without departing from the scope and spirit of the appended claims.

What is claimed is:

1. A module for use in one of providing information to and storing the information from an air conditioning apparatus, comprising:

a handheld transportable device including an outermost housing, an electronic memory housed within said housing, and a connector for connecting said device to a controller of said apparatus for transferring information therebetween, the information comprising:

at least one of a model number of air conditioning apparatus and a serial number of the air conditioning apparatus; and calibration data for operating parameters of said apparatus including selecting pressure and temperature limits specific to at least one of the model number and the serial number;

wherein the controller does not form a portion of a programmable thermostat and the model number and the serial number are not a model number or a serial number of a portion of a programmable thermostat;

wherein the handheld transportable device is configured to require communication with an external device to alter any information carried by the handheld transportable device and wherein the external device is located to the housing of the handheld transportable device; and wherein initially transferring the information converts the contoller from being incapable of controlling the air conditioning apparatus to being capable of controlling operation of the air conditioning apparatus and wherein the calibration data for operating parameters is necessary for at least an initial operation of the apparatus.

2. The invention set forth in claim 1 wherein:

said module is connectable to a processor for receiving information to be transferred to said controller.

3. The invention set forth in claim 1 wherein:

said information specific to at least one of said model number and said serial number is provided by said module to said controller and comprises at least one of an airflow rate and heat output capacity of said apparatus control of a blower motor speed based on selected heating and cooling operating conditions of said apparatus, maximum air flow and minimum air flow output by a blower of said apparatus, and blower rotation direction.

4. The invention set forth in claim 3 wherein:

said apparatus includes pressure and temperature sensors for indicating selected temperatures including return air temperature to said apparatus, temperature of air being discharged from said apparatus and combustion temperatures of said apparatus.

5. The invention set forth in claim 4 wherein:

said module is operable to at least one of receive and record data from said controller and provide data to said controller related to said temperatures and pressures.

6. The invention set forth in claim 1 including:

information communicating means associated with said module for transferring information to and from said module via an optical communication link.

7. The invention set forth in claim 1 wherein:

said memory of said module is a non volatile memory.

8. The invention set forth in claim 1 wherein:

said module is programmed to transfer information to said controller when connected thereto and when said controller is energized.

9. A method for one of providing information to and storing the information from an air conditioning apparatus, comprising:

providing a handheld transportable module including an outermost housing, an electronic memory housed within said housing, and a connector for connecting said module to a controller of said apparatus; and automatically transferring the information from the module to the controller in response to energization of the apparatus, the information comprising calibration data for operating parameters of said apparatus, the information being required to be received by the controller as a necessity prior to at least an initial operation of the apparatus;

wherein the controller does not form a portion of a programmable thermostat and the model number and the serial number are not a model number or a serial number of a portion of a programmable thermostat; and wherein the handheld transportable module is configured to require communication with an external device to alter any information carried by the handheld transportable module and wherein the external device is located external to the housing of the handheld transportable module.

10. The method set forth in claim 9 including the step of:

connecting said module to a processor for one of receiving information to be transferred to said controller and transferring information from said controller to said processor.

11. The method set forth in claim 9 including the step of:

providing information to said apparatus from said module comprising at least one of an airflow rate and heat output capacity of said apparatus, control of a blower motor speed based on selected heating and cooling operating conditions of said apparatus, maximum air flow and minimum air flow output by a blower of said apparatus, and blower rotation direction.

12. The method set forth in claim 9 wherein:

said apparatus includes temperature sensors for indicating selected temperatures including at least one of return air temperature to said apparatus, temperature of air being discharged from said apparatus and combustion temperatures of said apparatus, and said method includes the step of:

causing said module to at least one of receive and record data from said controller and provide data to said controller related to said temperature.

13. The method set forth in claim 9 including the step of:

transferring information to and from said module via an optical communication link.

14. The method set forth in claim 9 including the step of:

providing said memory of said module as a non volatile memory.

15. The method set forth in claim 9 including the step of:

programming said module to transfer the information to said controller when connected thereto and when said controller is energized.

* * * * *